US009377030B2

(12) United States Patent
Matwey et al.

(10) Patent No.: US 9,377,030 B2
(45) Date of Patent: Jun. 28, 2016

(54) AUXILIARY POWER UNITS AND OTHER TURBOMACHINES HAVING PORTED IMPELLER SHROUD RECIRCULATION SYSTEMS

(71) Applicant: HONEYWELL INTERNATIONAL INC., Morristown, NJ (US)

(72) Inventors: Mark Matwey, Phoenix, AZ (US); Mahmoud Mansour, Phoenix, AZ (US); Yogendra Y. Sheoran, Scottsdale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 586 days.

(21) Appl. No.: 13/853,951

(22) Filed: Mar. 29, 2013

(65) Prior Publication Data

US 2014/0294564 A1 Oct. 2, 2014

(51) Int. Cl.

| | |
|---|---|
| ***F04D 29/42*** | (2006.01) |
| ***F04D 29/68*** | (2006.01) |
| ***F04D 27/02*** | (2006.01) |
| ***F04D 29/44*** | (2006.01) |

(52) U.S. Cl.

CPC ..... *F04D 29/4213* (2013.01); *F04D 27/0207* (2013.01); *F04D 29/441* (2013.01); *F04D 29/444* (2013.01); *F04D 29/682* (2013.01); *F05D 2250/51* (2013.01)

(58) Field of Classification Search

CPC ..... F04D 27/0207; F04D 29/4213; F04D 29/441; F04D 29/444; F04D 29/682

USPC ..... 415/58.2, 58.4, 207, 58.3

See application file for complete search history.

(56) References Cited

U.S. PATENT DOCUMENTS

| | | | | |
|---|---|---|---|---|
| 4,981,018 | A | 1/1991 | Jones et al. | |
| 5,186,601 | A * | 2/1993 | Treece | F04D 29/4213 415/173.1 |
| 5,392,815 | A | 2/1995 | Stuart | |

(Continued)

FOREIGN PATENT DOCUMENTS

| | | |
|---|---|---|
| EP | 2518326 A2 | 10/2012 |
| JP | 1867108 | 8/1994 |

OTHER PUBLICATIONS

EP Examination Report for Application No. 14160796.0, dated Jun. 12, 2015.

(Continued)

*Primary Examiner* — Kenneth Bomberg
*Assistant Examiner* — Dapinder Singh
(74) *Attorney, Agent, or Firm* — Ingrassia Fisher & Lorenz, P.C.

(57) ABSTRACT

Embodiments of a turbomachine, such as a gas turbine engine, are provided. In one embodiment, the turbomachine includes an impeller, a main intake plenum in fluid communication with the inlet of the impeller, and an impeller shroud recirculation system. The impeller shroud recirculation system includes an impeller shroud extending around at least a portion of the impeller and having a shroud port therein. A shroud port cover circumscribes at least a portion of the shroud port and cooperates therewith to at least partially define an impeller recirculation flow path. The impeller recirculation flow path has an outlet positioned to discharge airflow into the main intake plenum at a location radially outboard of the shroud port when pressurized air flows from the impeller, through the shroud port, and into the impeller recirculation flow path during operation of the turbomachine.

20 Claims, 7 Drawing Sheets

(56) References Cited

U.S. PATENT DOCUMENTS

| | | | |
|---|---|---|---|
| 5,762,107 | A | 6/1998 | Laws |
| 6,447,241 | B2 | 9/2002 | Nakao |
| 2009/0004032 | A1 | 1/2009 | Kaupert |
| 2011/0274537 | A1 | 11/2011 | Duong et al. |
| 2013/0058762 | A1 | 3/2013 | Ring et al. |

OTHER PUBLICATIONS

EP Examination Report for Application No. 14160796.0, Dated Jul. 29, 2014.

EP Search Report for Application No. 14160796.0, Dated Jul. 10, 2014.

* cited by examiner

AUXILIARY POWER UNITS AND OTHER TURBOMACHINES HAVING PORTED IMPELLER SHROUD RECIRCULATION SYSTEMS

TECHNICAL FIELD

The present invention relates generally to turbomachines and, more particularly, to auxiliary power units and other turbomachines including ported impeller shroud recirculation systems, which may improve impeller surge margin, range, and other measures of impeller performance.

BACKGROUND

Centrifugal compressors, commonly referred to as "impellers," are often utilized within auxiliary power units and other types of gas turbine engines to provide a relatively compact means to compress airflow prior to delivery into the engine's combustion chamber. The impeller is typically surrounded by a generally conical or bell-shaped shroud, which helps guide the airflow from the forward section to the aft section of the impeller (commonly referred to as the "inducer" and "exducer" sections, respectively). Certain benefits in impeller performance can be realized by forming one or more ports through the impeller shroud to allow airflow in either of two directions, depending upon the operational conditions of the impeller. In particular, when the impeller is operating near the choke side of its operating characteristic, the ported impeller shroud port in-flows (that is, airflow is drawn into the impeller through the shroud port) to increase the choke side range of the impeller operating characteristic. Conversely, when the impeller is operating near the stall side of its operating characteristic, the ported impeller shroud outflows (that is, airflow is bled from the impeller through the shroud port) to increase the stall side range of the impeller operating characteristic. The airflow extracted from the impeller under outflow conditions may be discharged from the gas turbine engine, utilized as cooling airflow, or possibly redirected back to the inlet of the impeller by a relatively compact recirculation flow pathway for immediate reingestion by the impeller.

While conventional ported impeller shrouds of the type described above can improve impeller performance within limits, further improvements in impeller performance are still desirable. In this regard, it would be desirable to provide embodiments of a ported impeller shroud recirculation system allowing still further improvements in surge margin, range, and other measures of impeller performance. Ideally, such an improved ported impeller shroud recirculation system could be implemented in a relatively low cost, low part count, retrofitable, and straightforward manner and could provide reliable, passive operation. More generally, it would be desirable to provide embodiments of a gas turbine engine or other turbomachine employing such ported impeller shroud recirculation system. Other desirable features and characteristics of the present invention will become apparent from the subsequent Detailed Description and the appended Claims, taken in conjunction with the accompanying Drawings and the foregoing Background.

BRIEF SUMMARY

Embodiments of a turbomachine, such as a gas turbine engine, are provided. In one embodiment, the turbomachine includes an impeller, a main intake plenum in fluid communication with the inlet of the impeller, and an impeller shroud recirculation system. The impeller shroud recirculation system includes an impeller shroud extending around at least a portion of the impeller and having a shroud port therein. A shroud port cover circumscribes at least a portion of the shroud port and cooperates therewith to at least partially define an impeller recirculation flow path. The impeller recirculation flow path has an outlet positioned to discharge airflow into the main intake plenum at a location radially outboard of the shroud port when pressurized air flows from the impeller, through the shroud port, and into the impeller recirculation flow path during operation of the turbomachine.

In a further embodiment, the turbomachine includes an impeller and an impeller shroud, which extends around at least a portion of the impeller and has a shroud port therein. A shroud port cover is disposed around the impeller shroud and separated therefrom by a radial gap. An impeller recirculation flow path is at least partially defined by the impeller shroud and the shroud port cover. The impeller recirculation flow path discharges airflow upstream of the impeller when pressurized air flows from the impeller, through the shroud port, and into the impeller recirculation flow path during operation of the turbomachine. The impeller recirculation flow path comprises a radially-elongated diffuser section extending away from the rotational axis of the impeller in a radial direction to reduce the velocity components of airflow bled from the impeller prior to discharge of the airflow upstream of the impeller.

In a still further embodiment, the turbomachine, comprising includes an intake housing assembly containing a main intake plenum, an impeller having an inlet in fluid communication with the main intake plenum, and an impeller shroud extending around at least a portion of the impeller and having a shroud port therein. An impeller recirculation flow path has an inlet fluidly coupled to the shroud port and has an outlet recessed within the intake housing assembly. The impeller recirculation flow path is configured to discharge airflow into the main intake plenum at a location radially outboard of the shroud port when pressurized air flows from the impeller, through the shroud port, and into the impeller recirculation flow path during operation of the turbomachine.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
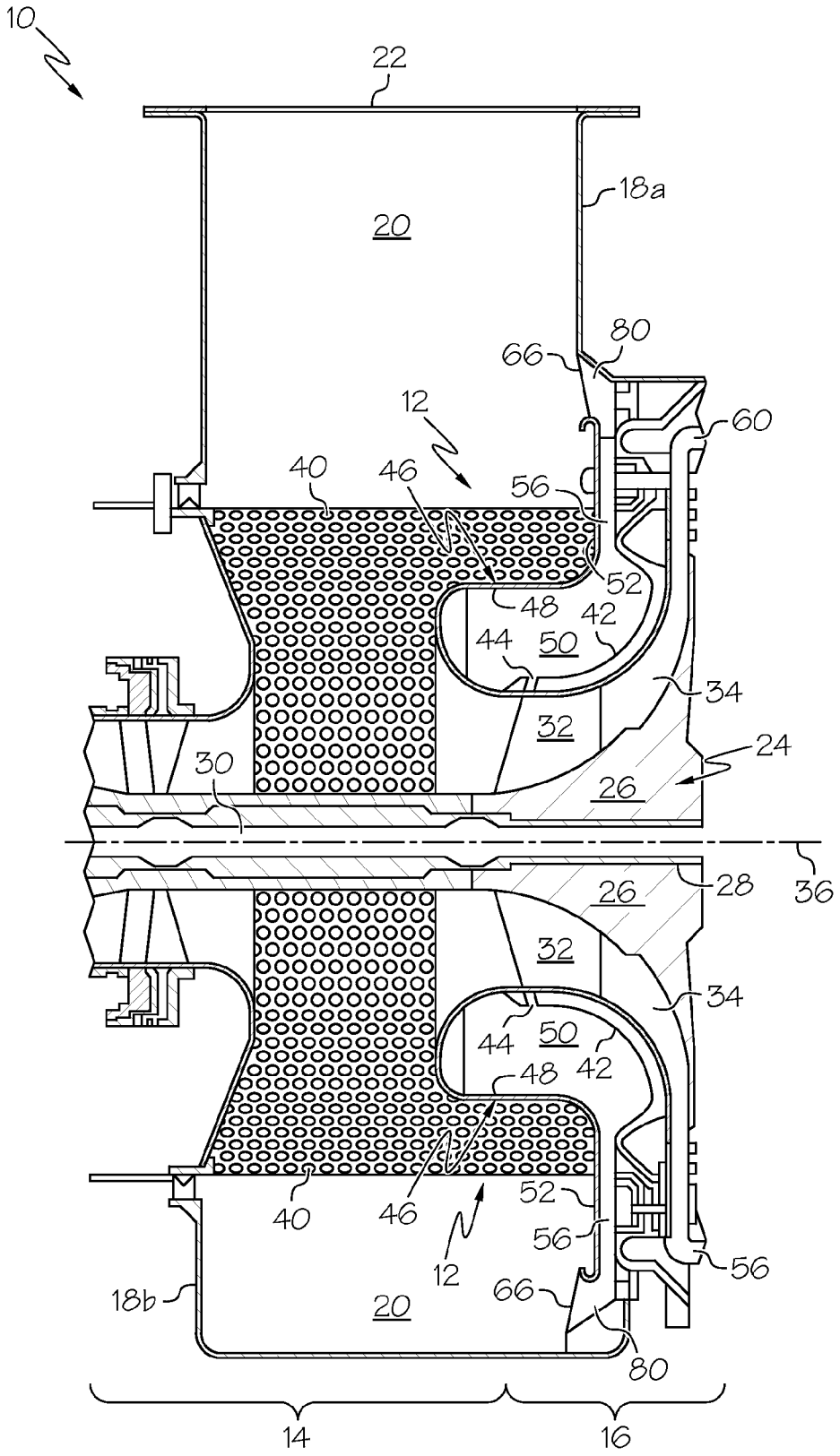
FIG. 1 is a cross-sectional view of an auxiliary power unit (partially shown) including an impeller shroud recirculation system, as illustrated in accordance with a first exemplary embodiment of the present invention.

FIG. 1 is a cross-sectional view of a turbomachine 10 including a ported impeller shroud recirculation system 12, as illustrated in accordance with an exemplary and non-limiting embodiment of the present invention. In the illustrated example, turbomachine 10 is an auxiliary power unit and will consequently be referred to herein below as "auxiliary power unit 10" or "APU 10." It will be appreciated, however, that embodiments of ported impeller shroud recirculation system 12 can be integrated into any impeller-containing turbomachine wherein improvements in surge margin and other aspects of impeller performance are sought. For example, in further implementations, ported impeller shroud recirculation system 12 can be employed within various different types of gas turbine engines, such as propulsive gas turbine engines deployed onboard aircraft and other vehicles, turboshaft engines utilized for industrial power generation, or another type of gas turbine engine. Ported impeller shroud recirculation system 12 can also be employed within non-gas turbine engine turbomachines, such as turbochargers.

Figure 2:
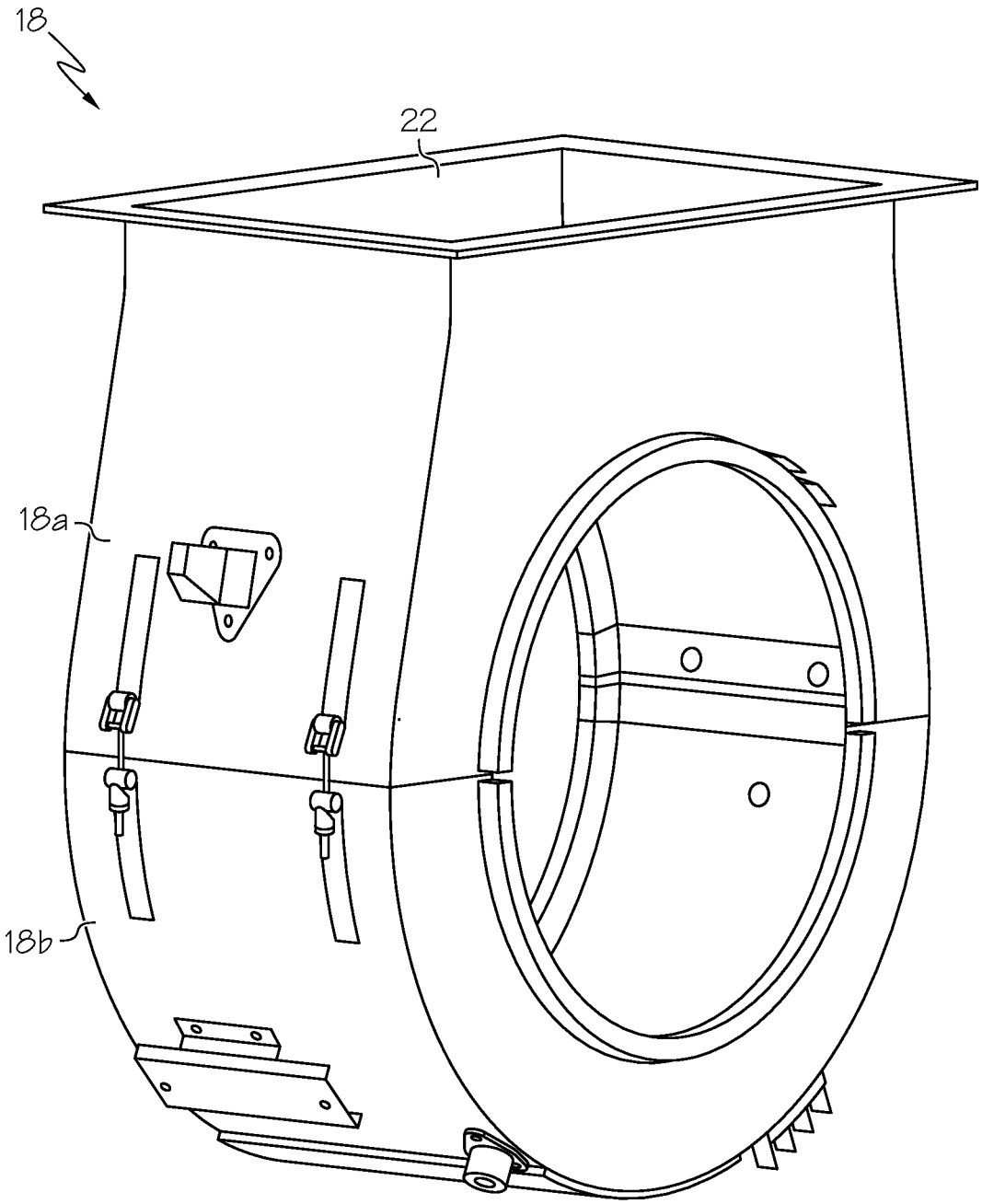
FIG. 2 is an isometric view of an intake housing assembly that may be included in the auxiliary power unit shown in FIG. 1.

The illustrated portion of APU 10 shown in FIG. 1 includes an intake section 14 and a compressor section 16, which is disposed downstream of intake section 14. APU 10 also includes combustor, turbine, and exhaust sections, which are disposed downstream of compressor section 16 in flow series; however, these sections of APU 10 are conventionally known and are not shown in FIG. 1 for clarity. A main housing assembly 18 encloses the various sections of APU 10. Housing assembly 18 includes, amongst other structures, two intake housing members 18(*a*) and 18(*b*), which are joined together to enclose intake section 14. This may be more fully appreciated by referring to FIG. 2, which illustrates intake housing members 18(*a*) and 18(*b*) from an isometric perspective. Referring collectively to FIGS. 1 and 2, intake housing members 18(*a*) and 18(*b*) enclose a generally annular volume of space, which is referred to herein as the "main intake plenum" and identified in FIG. 1 by reference numeral 20. Main intake plenum 20 is fluidly coupled to the ambient environment by a main inlet 22, which may assume the form of a generally rectangular opening provided in an upper portion of intake housing member 18(*a*). A central opening 23 (identified in FIG. 2) is provided through inlet housing subassembly 18(*a*), 18(*b*) formed by intake housing members 18(*a*) and 18(*b*), when assembled, to accommodate the various components of APU 10 located within intake section 14, as described more fully below.

As shown in FIG. 1, compressor section 16 of APU 10 houses a centrifugal compressor or "impeller" 24. Impeller 24 includes a disc-shaped body or hub 26, which has longitudinal bore or central channel 28 through which a central shaft 30 extends. Impeller 24 is mounted to shaft 30 in a rotationally-fixed relationship such that impeller 24 and shaft 30 rotate in unison about a rotational axis 36, which may be substantially coaxial with the centerline of APU 10. A plurality of primary impeller blades 32 are angularly spaced about the circumference of hub 26 and extend radially outward therefrom. Primary impeller blades 32 wrap or twist around rotational axis 36, when impeller 24 is viewed along rotational axis 36. As indicated in FIG. 1, primary impeller blades 32 each extend essentially the entire length of hub 26; that is, from the forward or "inducer" section of impeller 24 to the aft or "exducer" section thereof. Impeller 24 may also include a number of truncated splitter blades 34, which extend radially from the exducer section of impeller 24 exclusively. Impeller blades 32, 34 and hub 26 may be produced as a single piece or unitary blisk. Alternatively, impeller blades 32, 34 may be fixedly joined to hub 26 utilizing, for example, an interlocking interface, such as a fir tree interface.

During operation of APU 10, shaft 30 and impeller 24 rotate to draw ambient air through main inlet 22 and into main intake plenum 20 of intake section 14. From intake section 14, the airflow is directed into compressor section 16 and, specifically, into the inlet of impeller 24. In the exemplary embodiment illustrated in FIG. 1, APU 10 includes two additional structural features to promote smooth, uniform airflow from intake section 14 into the inlet of impeller 24. First, a bellmouth structure 38 is positioned within intake section 14 axially adjacent to and immediately upstream of impeller 24; e.g., bellmouth structure 38 may be bolted or otherwise affixed to the ported impeller shroud and/or the impeller shroud cover described below. Bellmouth structure 38 serves to consolidated and gently accelerate airflow as it enters impeller 24. As a second flow condition feature, a tubular body having a series of circumferential openings therein (referred as "tubular perforated plate 40" or, more simply, "perforated plate 40") is mounted within intake section 14 between main inlet 22 and the inlet of impeller 24. In the illustrated example, perforated plate 40 extends around a forward portion of impeller 24 and is substantially concentric with rotational axis 36. Perforated plate 40 promotes radially uniform airflow from main intake plenum 20 into the core airflow path of APU 10 and may also help to prevent ingestion of large debris by impeller 24. In certain embodiments, perforated plate 40 may also perform an airflow straightening or "de-swirl" function by reducing the circumferential velocity component of the airflow supplied to main intake plenum 20 by ported impeller shroud recirculation system 12, as described below in conjunction with FIG. 3. While providing the above-noted benefits, perforated plate 40 and/or bellmouth structure 38 may be omitted in alternative embodiments of ported impeller shroud recirculation system 12, such as the embodiment described below in conjunction with FIG. 7.

A ported impeller shroud 42 is disposed around impeller 24 and, specifically, circumscribes the inducer section of impeller 24 and a portion of the exducer section thereof. Impeller shroud 42 may have a generally bell-shaped or conical geometry. Impeller shroud 42 is "ported" in the sense that shroud 42 includes an orifice or port 44 formed therethrough. Shroud port 44 may be a continuous annular opening or gap formed in the body of impeller shroud 42 or, instead, a series of circumferentially-spaced openings or apertures formed in shroud 42. In embodiments wherein shroud port 44 is formed as a continuous annular opening or gap, impeller shroud 42 may include connecting structures, such as arch-shaped bridges (not shown), to join to the sections of shroud 42 separated by port 44. As previous noted, shroud port 44 allows bi-directional airflow across the body of impeller shroud 42 depending upon the operational conditions of impeller 24. Under so-called "inflow conditions," which typically occur when impeller 24 operating near the choke side of its operating characteristic, pressurized air flows into impeller 24 through shroud port 44 to increase the choke side range of the impeller operating characteristic. Conversely, under so-called "outflow conditions," which typically occur when impeller 24 is operating near the stall side of its operating characteristic, pressurized air is extracted from or bled from impeller 24 through shroud port 44 to increase the stall side range of the impeller operating characteristic.

Certain ported impeller shroud recirculation systems are known wherein the port outflow bled from an impeller through ported shroud under outflow conditions is recirculated back to the impeller inlet. However, in such known recirculation systems, the impeller port outflow is typically immediately returned to the inlet of the impeller by a relatively compact short flow path to allow the recirculated airflow to be quickly reingested by the impeller. Advantageously, such a configuration minimizes plumbing requirements and can be fit into a relatively compact spatial envelope. The present inventors have determined, however, that the immediate return of the impeller port outflow to the inlet of the impeller can place unexpected limitations on impeller performance. In particular, the present inventors have discovered that such "close-coupled" recirculation systems wherein the impeller port outflow is immediately recycled to the impeller inlet can negatively impact impeller inlet vector diagrams. Such vector diagram effects can be reduced, within certain limits, if the close-coupled recirculation system is equipped with a deswirl device to minimize the circumferential velocity or swirl component of the recycled airflow; however, even with the usage of a deswirl device, the axial and radial velocity diagrams may still be affected, most predominately at the impeller inlet tip. Such effects can limit the impeller performance due to, for example, high Mach number mixing losses and undesirable impingement of the airflow on the leading edge portions of the impeller.

As compared to close-coupled recirculation systems of the type described above, impeller shroud recirculation system 12 can improve impeller performance in a number of different manners. First, impeller shroud recirculation system 12 can decrease mixing losses due, at least in part, to extraction of the port outflow into an intermediate plenum having a relatively large volume, such as discharge plenum 50 described below in conjunction with FIGS. 1, 3, 6 and 7. Second, impeller shroud recirculation system 12 serves to significantly reduce the swirl component of the impeller port outflow prior to reingestion by impeller 24 utilizing a radial diffusion process, possibly in combination with one or more deswirl features. By providing a high radius impeller port outflow discharge into the main intake plenum 20 at a relatively low Mach number and with significantly diminished swirl, recirculation system 12 allows for the reinjected impeller port outflow to be dominated by the flow structure created by the main intake plenum 20 and thereby have minimal effect on the impeller leading edge. As a result, impeller shroud recirculation system 12 effectively fluidly isolates or de-couples the impeller inlet from impeller port outflow reinjection effects to improve impeller performance, such as the stall side performance and range.

Figure 3:
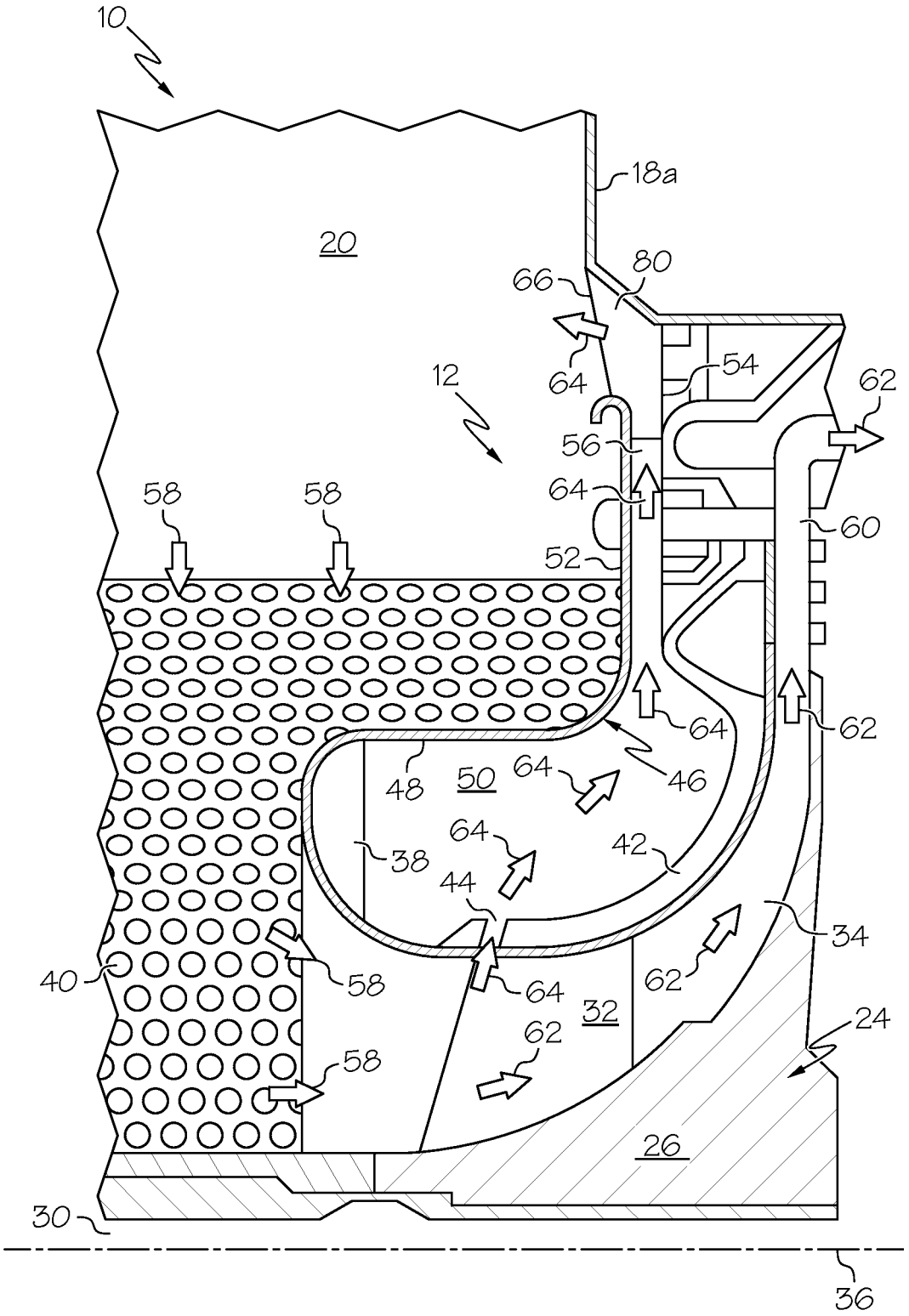
FIG. 3 is a cross-sectional view of the auxiliary power unit shown in FIG. 1 illustrating the exemplary impeller shroud recirculation system in greater detail.

FIG. 3 is a cross-sectional view of APU 10 illustrating impeller shroud recirculation system 12 in greater detail. Impeller shroud recirculation system 12 includes an impeller shroud cover 46, which is disposed over impeller shroud 42 and is substantially concentric therewith. Shroud cover 46 includes an outer plenum wall 48, which circumscribes the forward portion of impeller shroud 42 through which port 44 is formed. Outer plenum wall 48 is radially offset or spaced apart from impeller shroud 42 by a radial gap. As a result of this offset, an annular volume of space 50 (referred to herein as "recirculation plenum 50") is defined between impeller shroud cover 46 and impeller shroud 42. More specifically, the outer circumference of annular recirculation plenum 50 is bound by impeller shroud cover 46, while the inner circumference of recirculation plenum 50 is bound by impeller shroud 42. The forward face of annular recirculation plenum 50 may further be bound by bellmouth structure 38, while the aft face of recirculation plenum 50 is generally bound by the exducer section of impeller shroud 42. As indicated in FIG. 3, the forward or leading end of outer plenum wall 48 may be axially adjacent, may abut, and/or may be mounted to an outer circumferential portion of bellmouth structure 38. In an embodiment, outer plenum wall 48 of impeller shroud cover 46 may have a substantially tubular or conical shape. In other embodiments, outer plenum wall 48 may have a bellmouth shape, such as that shown in FIG. 7. In the illustrated exemplary embodiment, outer plenum wall 48 is circumscribed by tubular perforated plate 40 and is substantially concentric with centerline 36 of APU 10.

Impeller shroud cover 46 further includes an aft or trailing flange 52, which extends radially outward from the aft end of outer plenum wall 48. As indicated in FIG. 3, trailing flange 52 may assume the form of, for example, a disc-shaped rim, which is joined to outer plenum wall 48 of shroud cover 46 at a substantially right angle to impart shroud cover 46 with a substantially L-shaped cross-sectional geometry with a radius at the interface between outer plenum wall 48 and trailing flange 52. In other embodiments, trailing flange 52 may have a bell-shaped or conical geometry. When shroud cover 46 is installed within APU 10, trailing flange 52 is axially offset or spaced apart from a neighboring wall 54 or other infrastructure provided within APU 10. Collectively, trailing flange 52 of shroud cover 46 and neighboring wall 54 define a radially-elongated flow passage 56, which is referred to herein as "radially-extending diffuser section 56." Diffuser section 56 may encompass a substantially annular volume of space, when viewed in three dimensions. In the illustrated example, diffuser section 56 extends in an essentially radial direction away from rotational axis 36 from a point radially inboard of impeller 24 to a point radially outboard thereof, when viewed in cross-section along a cut plane containing rotational axis 36.

Radially-extending diffuser section 56 is fluidly coupled between annular recirculation plenum 50 and main intake plenum 20. Collectively, diffuser section 56 and recirculation plenum 50 form an impeller recirculation flow path 50, 56, which returns airflow bled from impeller 24 through shroud port 44 under outflow conditions to main intake plenum 20. More specifically, during operation of APU 10, airflow is drawn into the inlet of impeller 24 from main intake plenum 20, as indicated in FIG. 3 by arrows 58. A large fraction of this airflow is compressed by impeller 24, discharged from the exducer of impeller 24, and then directed by a diffuser 60 into a non-illustrated combustion chamber for combustion, as indicated in FIG. 3 by arrows 62. Under outflow conditions, a fraction of the airflow is also extracted from the inducer section of impeller 24 through shroud port 44 of impeller shroud 42. The pressurized airflow bled through shroud port 44 is directed into annular recirculation plenum 50, flows through radially-extending diffuser section 56, and is ultimately reinjected back into main intake plenum 20 through diffuser section 56, as indicated in FIG. 3 by arrows 64. After being recirculated to main intake plenum 20, the shroud port outflow flows through perforated plate 40 and is reingested and recompressed by impeller 24 to complete the flow circuit.

The port through which airflow bled from impeller 24 is reinjected back into main intake plenum is identified in FIG. 3 by reference numeral "66" and is referred to herein as "diffuser section outlet 66" in view of the direction of airflow during outflow conditions when impeller shroud recirculation system 12 performs its recirculation function. It should be appreciated, however, that airflow will also be drawn into diffuser section outlet 66 (such that arrows 64 would reversed) during inflow conditions of the type previously described. As indicated in FIG. 3, diffuser section outlet 66 is preferably located radially outboard of shroud port 44. Stated differently, in preferred embodiments, the distance between diffuser section outlet 66 and the rotational axis/centerline 36 of APU 10 is greater than the distance between shroud port 44 and rotational axis/centerline 36. In more preferred embodiments, and as further indicated in FIG. 3, diffuser section outlet 66 may also be located radially outboard of the trailing outer edge or exit radius of impeller 24 and/or perforated plate 40. Lastly, it is preferred, although by no means necessary, that the distance between diffuser section outlet 66 and rotational axis 36 is greater than or substantially equivalent to one half the maximum outer diameter of impeller 24.

When airflow is initially bled from impeller 24 under outflow conditions of the type described above, the pressurized airflow enters recirculation plenum 50 having a considerable circumferential velocity due to high speed rotation of impeller 24 and, specifically, of impeller blades 32, 34. Impeller recirculation flow path 50, 56 first receives the port outflow in a relatively large volume plenum 50 and then directs the port outflow radially or tangentially outward over a radially-elongated diffuser section 56. In so doing, impeller recirculation flow path 50, 56 allows both the radial and the circumferential component or swirl of the shroud port outflow to be significantly reduced as the kinetic energy of the pressurized airflow decreases. The swirl of the port outflow has been thus largely reduced, if not entirely eliminated, when discharged through diffuser section outlet 66 into main inlet plenum 20 thereby preventing high Mach number mixing losses within plenum 20. Perforated plate 40 may also help remove any remaining swirl component present in the port outflow prior to reingestion by impeller 24, as least in certain embodiments. In further embodiments, multiple perforated plates 40 may be combined in, for example, a concentric arrangement to further promote removal or reduction of the swirl component of the recirculated airflow prior to reingestion by impeller 24. Notably, impeller shroud recirculation system 12 provides the above-described de-swirl function in a reliable and wholly passive manner. Additionally, by fluidly isolating the shroud port outflow from the impeller inlet, erratic or varied impingement of the shroud port outflow on the leading edge region of impeller 24 is eliminated or at least reduced as compared to close-coupled ported shroud design of the type described above.

Figure 4:
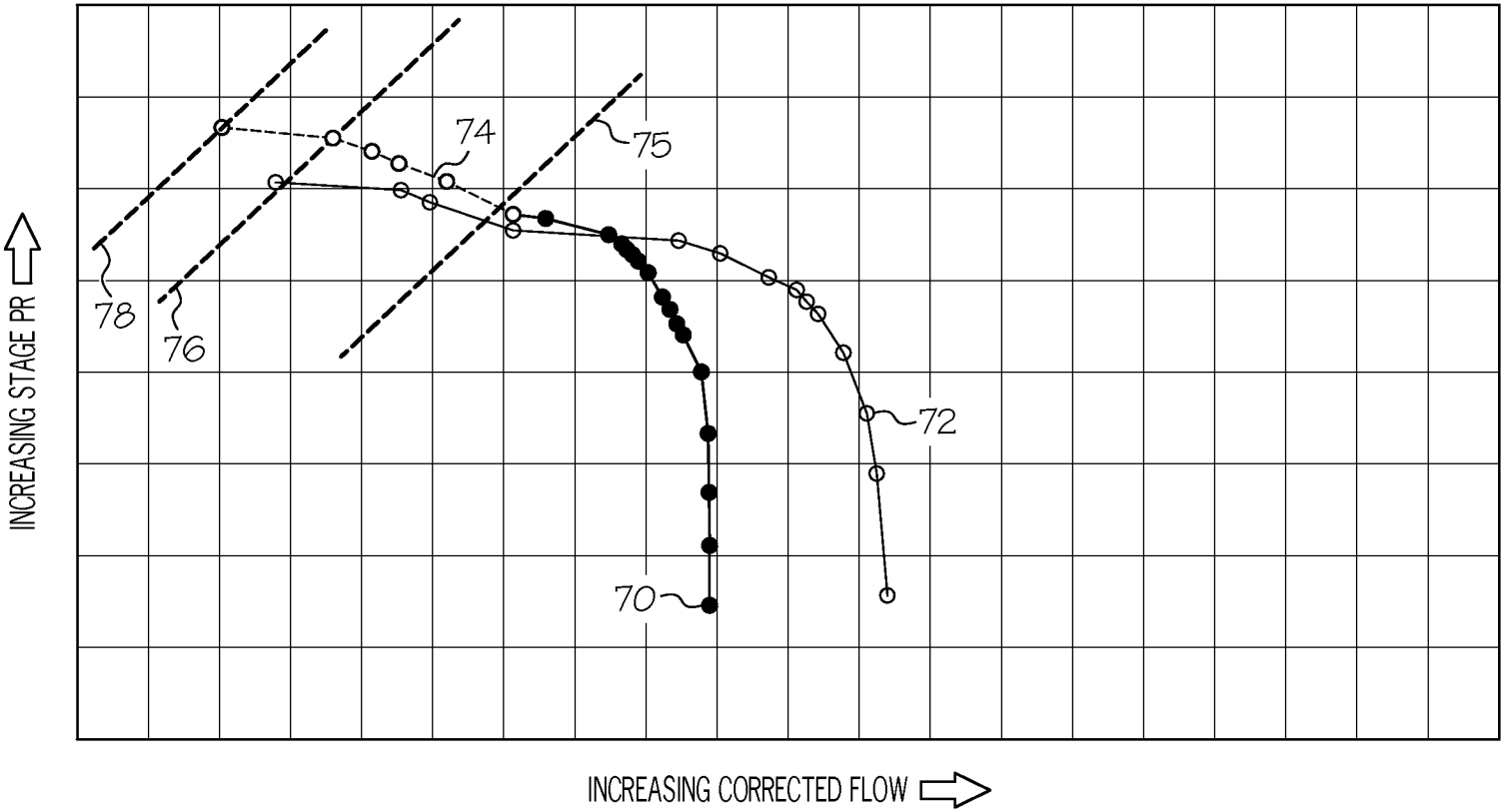
FIG. 4 is a graph of stage pressure ratio (vertical axis) versus corrected flow (horizontal axis) plotting the operational characteristics for an impeller utilized with a non-ported shroud, an impeller utilized with an impeller shroud recirculation system lacking impeller port outflow swirl control, and an impeller utilized with the improved impeller shroud recirculation system shown in FIGS. 1 and 3 having impeller port outflow swirl control.

FIG. 4 is a graph illustrating improvement in surge margin that may be provided by impeller shroud recirculation system 12, in accordance with an exemplary analytical model. In FIG. 4, the vertical axis denotes stage pressure ratio (outlet pressure over inlet pressure) and the horizontal axis denotes corrected flow (mass flow rate corrected to standard day conditions). Three profiles are shown: (i) a first profile 70 representing the performance characteristic of an impeller surrounded by a non-ported shroud; (ii) a second profile 72 representing the performance characteristic of an impeller surrounded by a conventional ported shroud wherein the shroud port outflow is recycled into the main inlet plenum 20, while having a significant circumferential velocity component or swirl (no impeller port outflow swirl control); and (iii) a third profile 74 representing the performance characteristic of impeller 24 (FIGS. 1 and 3) wherein impeller shroud recirculation system 12 has significantly reduced or entirely eliminated the swirl component of the shroud port outflow prior to reinjection into main inlet plenum 20 (FIG. 1) and eventual reingestion by impeller 24. Surge lines 75, 76, and 78 are associated with profiles 70, 72, and 74, respectively. As can be seen, impeller shroud recirculation system 12 increases the stage pressure ratio and decreases the corrected flow rate at surge thereby improving surge margin between surge lines 76 and 78. As the surge margin of impeller 24 is improved, so too is the operational range of impeller 24.

Figure 5:
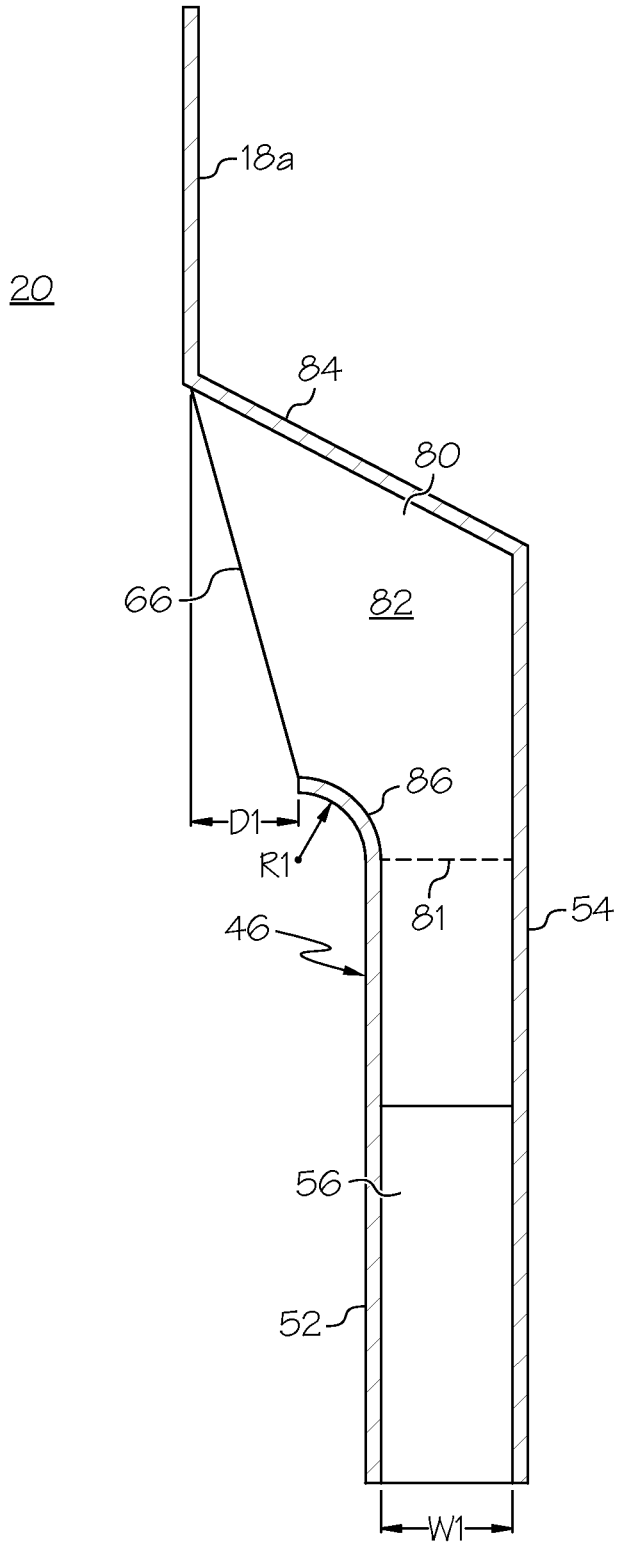
FIG. 5 is a cross-sectional view of the radially-extending diffuser section included within the exemplary impeller shroud recirculation system shown in FIGS. 1 and 3 and illustrating, in greater detail, one of a number of de-swirl vanes that may be positioned within the diffuser section.

In certain embodiments, directing the shroud port outflow through recirculation flow path 50, 56 may provide sufficient reduction of the circumferential velocity component of the shroud port outflow to achieve the desired improvements in impeller performance. In such cases, impeller shroud recirculation system 12 may not include additional flow conditioning or swirl-reducing structures. However, in certain cases, it may be desirable to equip impeller shroud recirculation system 12 with additional features to still further reduce the swirl component of the shroud port outflow prior to discharge into main inlet plenum 20. For example, impeller shroud recirculation system 12 may further be equipped with an annular array of de-swirl vanes, which are positioned within recirculation flow path 50, 56 and circumferentially spaced about centerline 36 at substantially regular intervals. This may be more fully appreciated by referring to FIG. 5, which is a cross-sectional view of radially-extending diffuser section 56 illustrating one such de-swirl vane 80 that may be disposed within diffuser section 56 proximate outlet 66. De-swirl vanes 80 may each have any geometry suitable for reducing the tangential or circumferential component of airflow passing therethrough. De-swirl vanes 80 may or may not have an airflow shape, when viewed individually from a top-down or planform perspective. De-swirl vanes 80 preferably extend essentially in radial and axial directions. As indicated in FIG. 5 by dashed line 81, the de-swirl vanes 80 may be conceptually divided into upper and lower regions, either of which may be excluded in different embodiments of impeller shroud recirculation system 12. In still further embodiments, various other types of de-swirl features may disposed within impeller recirculation flow path 50, 56, such as perforated plates and/or flow straightening tubes.

In the exemplary embodiment illustrated in FIGS. 3 and 5, impeller shroud recirculation system 12 further includes an angled outlet region 82, which turns the shroud port outflow in an aftward direction to further reduce the circumferential velocity component of the shroud port outflow prior to reinjection into main intake plenum 20. Angled outlet region 82 is formed, in part, by an overhanging sidewall region 84 of intake housing member 18(*a*). Diffuser section 56 and diffuser section outlet 66 are thus recessed within a sidewall wall of intake housing member 18(*a*). Due to this recessed configuration, the likelihood of ingestion of ice or other foreign object debris during inflow conditions through diffuser outlet 66, which could potentially obstruct diffuser section 56, is reduced. The degree to which diffuser section outlet 66 is recessed within intake housing member wall 18(*a*) will vary amongst embodiments; however, in the illustrated example wherein the outer terminal edge of flange 52 is imparted with a curved inner lip or bellmouth 86 having a radius $R_1$, the overhang or recess distance (identified in FIG. 5 as "$D_1$") may be between 0 and about 3 $R_1$. The axial or flow passage width $W_1$ of diffuser section 56 is preferably as least as wide as the axial width of the shroud port 44, in an embodiment. Furthermore, the radius $R_1$ is preferably less than $W_1$, in an embodiment. By imparting diffuser outlet 66 with bellmouth 86 having a radius $R_1$, flow pressure loss can be reduced during both inflow and outflow. In further embodiments, impeller shroud recirculation system 12 may be equipped with various different types of tortuous flow paths, ramps, or the like similar to those included in a conventional inlet particle separation system to further minimize the likelihood of the ingestion of moisture and/or foreign object debris into impeller recirculation flow path 50, 56 during inflow conditions.

The foregoing has thus provided embodiments of a turbomachine and, specifically, an auxiliary power unit including a ported impeller shroud recirculation system improving surge margin, range, and other measures of impeller performance. The above-described impeller shroud recirculation system can be implemented in a relatively low cost, low part count, and straightforward manner and provides reliable, passive operation. Advantageously, embodiments of the above-described impeller shroud recirculation system can also be installed as a retrofit into existing turbomachines, such as service-deployed auxiliary power unit. While primarily described in the context of a particular type of turbomachine, namely, an auxiliary power unit, it is emphasized that embodiments of the impeller shroud recirculation system can be utilized in conjunction with other types of gas turbine engines and turbomachines, generally, including turbochargers.

Figure 6:
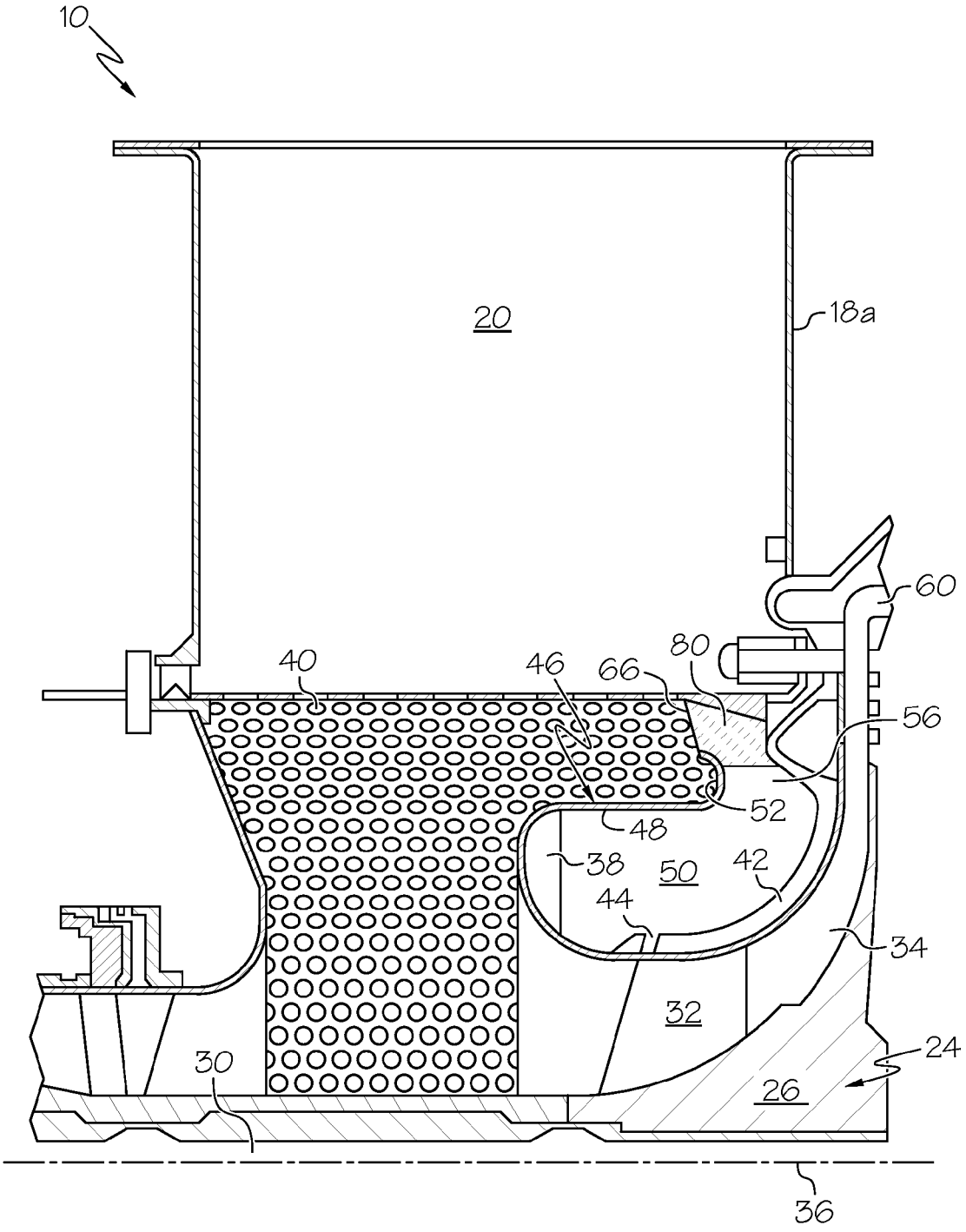
FIG. 6 is a cross-sectional view of an auxiliary power unit (partially shown) including an impeller shroud recirculation system, as illustrated in accordance with a further exemplary embodiment of the present invention.

In exemplary embodiment described above in conjunction with FIGS. 1-5, radially-extending diffuser section 56 extended beyond perforated plate 40, as taken in a radial direction, such that outlet 66 was located radially outboard of plate 40 (shown most clearly in FIGS. 1, 3, and 5). While such a configuration will typically provide the greatest reduction in swirl and is consequently preferred, such a configuration may not always be practical due to spatial constraints. Thus, in certain embodiments, the impeller recirculation flow path may direct pressurized airflow bled through the shroud port under outflow conditions to a radial location closer to the centerline or rotational axis of the impeller, although still located radially beyond or outboard of the shroud port 44. Further illustrating this point, FIG. 6 is a cross-sectional view of APU 10 and impeller shroud recirculation system 12, as illustrated in accordance with a second exemplary embodiment and wherein like reference numerals are utilized to denote like (but not necessarily identical) elements. In this embodiment, diffuser section 56 extends radially outward from annular recirculation plenum 50, but does not extend radially beyond tubular perforated plate 40. Instead, diffuser section 60 terminates near the inner wall of tubular perforated plate 40 such that diffuser section outlet 66 is located radially adjacent plate 40. As a result, the outer diameter of impeller shroud recirculation system 12 is reduced. This may be especially desirable in embodiments wherein recirculation system 12 is retrofit into an existing APU. This also provides the additional benefit of utilizing perforated plate 40 to help shield outlet 66 from debris ingestion during inflow conditions. As was the case previously, impeller recirculation flow path 50, 56 may have an angled outlet region to turn the port outflow aftward prior to reinjection into main intake plenum 20 (and noting that plenum 20 also includes the annular volume of space within plate 40). Additionally, a circumferentially-spaced array of de-swirl vanes 80 (one of which is shown in FIG. 5) may be positioned within impeller recirculation flow path 50, 56 and, preferably, within diffuser section 56.

Figure 7:
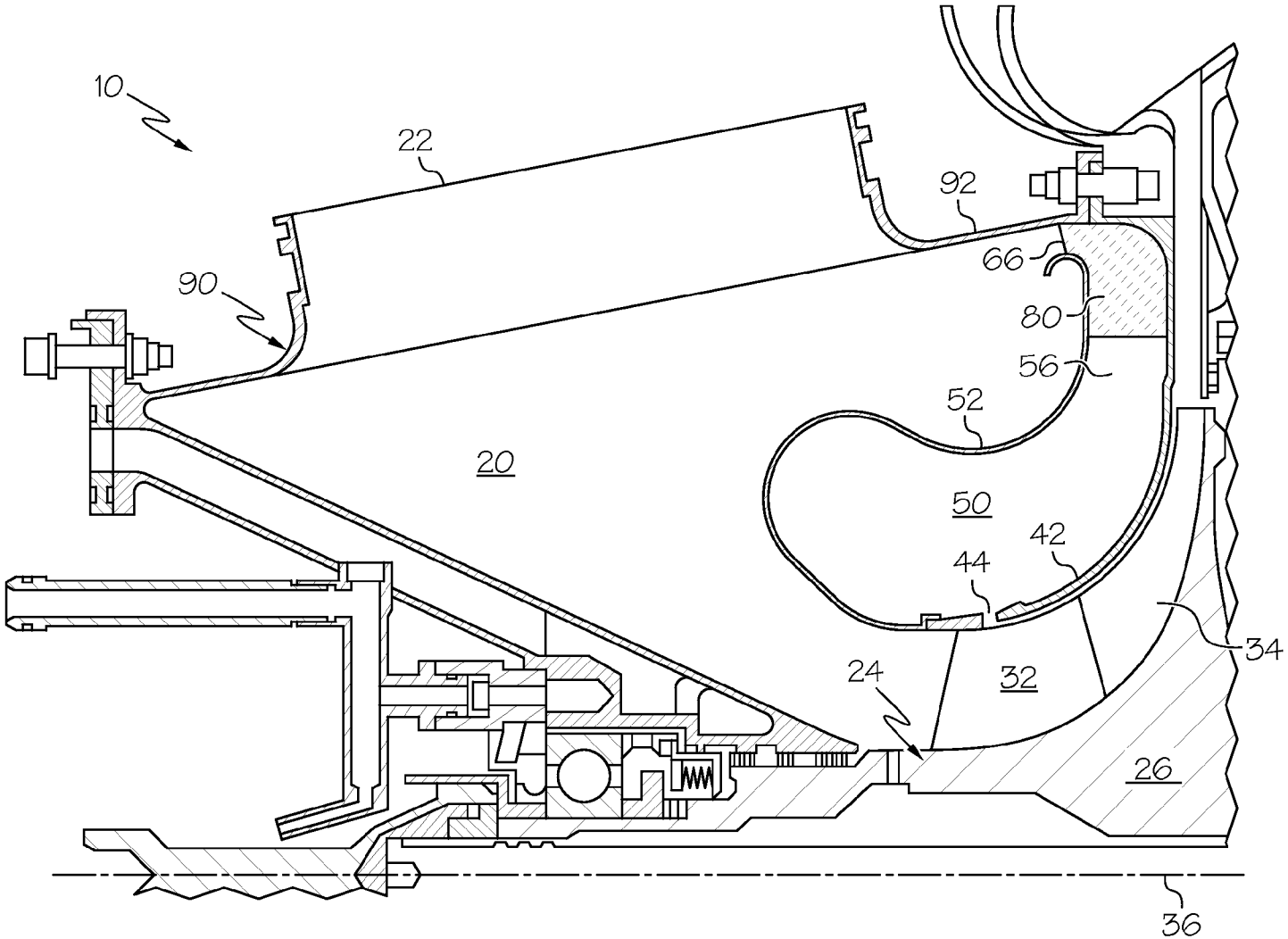
FIG. 7 is a cross-sectional view of an auxiliary power unit (partially shown) including an impeller shroud recirculation system, as illustrated in accordance with a still further exemplary embodiment of the present invention.

While embodiments of the auxiliary power unit or other turbomachine advantageously include one or more perforated plates (or similar flow conditioning structure) in addition to the ported impeller shroud recirculation system, embodiments of the turbomachine may not include a perforated plate to, for example, further reduce envelope and weight. In this regard, FIG. 7 is a cross-sectional view of auxiliary power unit 10, as illustrated in accordance with a still further exemplary embodiment wherein APU 10 includes impeller shroud recirculation system 12, but lacks a perforated plate. In this embodiment, APU 10 has a highly compact intake section, which is enclosed by housing assembly 90. Impeller recirculation flow path 50, 56 also has a relatively compact geometry, although the outlet 66 of flow path 50, 56 remains located radially outboard of shroud port 44 and impeller 24. More specifically, radially-extending diffuser section 56 extends radially outward from annular recirculation plenum 50 and terminates proximate an outer inside wall 92 of inlet housing assembly 90 through which inlet 22 is formed. Once again, impeller recirculation flow path 50, 56 is imparted with an angled outlet region to turn the port outflow aftward prior to reinjection into main intake plenum 20 and includes a plurality of de-swirl vanes 80 positioned within diffuser section 56 proximate outlet 66. Thus, in the embodiment shown in FIG. 7, APU 10 again provides improvements in impeller surge margin and range similar to those described above in conjunction with FIGS. 1-5.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A turbomachine, comprising:

an impeller having an inlet and a rotational axis;

a main intake plenum in fluid communication with the inlet of the impeller;

an impeller shroud recirculation system, comprising:

an impeller shroud extending around at least a portion of the impeller and having a shroud port therein;

a shroud port cover circumscribing at least a portion of the shroud port; and an impeller recirculation flow path defined, at least in part, by the shroud port cover and the impeller shroud, the impeller recirculation flow path having an outlet positioned to discharge airflow into the main intake plenum at a location radially outboard of the shroud port when pressurized air flows from the impeller, through the shroud port, and into the impeller recirculation flow path during operation of the turbomachine;

wherein the impeller recirculation flow path further comprises a radially-extending diffuser section fluidly coupled between the shroud port and the main intake plenum, the radially-extending diffuser section extending in essentially a radial direction away from the rotational axis from a point radially inboard of the impeller to a point radially outboard thereof.

2. The turbomachine of claim 1 wherein the distance between the outlet of the impeller recirculation flow path and the rotational axis of the impeller is substantially equivalent to or greater than one half the maximum outer diameter of the impeller.

3. The turbomachine of claim 1 wherein the radially-extending diffuser section is at least partially defined by the shroud port cover.

4. The turbomachine of claim 1 wherein the radially-extending diffuser section has a flow passage width $W_1$, and wherein the outlet of the impeller recirculation flow path includes a bellmouth having a radius $R_1$ less than width $W_1$.

5. The turbomachine of claim 1 wherein the impeller shroud recirculation system further comprises a plurality of de-swirl vanes positioned within the radially-extending diffuser section and angularly spaced about the rotational axis of the impeller.

6. The turbomachine of claim 1 further comprising an intake housing assembly defining the main intake plenum, the outlet of the impeller recirculation flow path recessed within the intake housing assembly.

7. The turbomachine of claim 1 wherein the impeller recirculation flow path has an angled outlet region configured to discharge airflow into the main intake plenum in an aftward direction when pressurized air flows from the impeller, through the shroud port, and into the impeller recirculation flow path during operation of the turbomachine.

8. The turbomachine of claim 1 further comprising a bellmouth structure upstream of the impeller, the bellmouth structure extending between impeller shroud and the shroud port cover.

9. The turbomachine of claim 1 wherein the shroud port cover comprises a trailing flange, and wherein the turbomachine further comprise a wall axially spaced from the trailing flange to define at least a portion of the radially-extending diffuser section.

10. The turbomachine of claim 1 wherein the impeller recirculation flow path further comprises an annular recirculation plenum fluidly at least partially defined by the shroud port cover and coupled between the radially-extending diffuser section and the main intake plenum.

11. The turbomachine of claim 10 wherein the annular recirculation plenum circumscribes at least a portion of the impeller port shroud.

12. The turbomachine of claim 10 wherein the shroud port cover comprises:

an outer plenum wall; and a trailing flange extending radially from the outer plenum wall.

13. The turbomachine of claim 12 wherein the outer plenum wall bounds the outer circumference of the shroud port cover, and wherein the trailing flange bounds a leading face of the radially-extending diffuser section.

14. The turbomachine of claim 1 further comprising a tubular perforated plate fluidly coupled between the main intake plenum and the inlet of the impeller.

15. The turbomachine of claim 14 wherein the outlet of the impeller recirculation flow path is positioned radially inboard of and radially adjacent to the tubular perforated plate.

16. The turbomachine of claim 14 wherein the outlet of the impeller recirculation flow path is positioned radially outboard of the tubular perforated plate.

17. The turbomachine of claim 16 wherein an aft end portion of the tubular perforated plate is disposed axially adjacent an aft end portion of the shroud port cover.

18. A turbomachine, comprising:

an impeller;

an impeller shroud extending around at least a portion of the impeller and having a shroud port therein;

a shroud port cover disposed around the impeller shroud and separated therefrom by a radial gap;

an impeller recirculation flow path at least partially defined by the impeller shroud and the shroud port cover, the impeller recirculation flow path discharging airflow upstream of the impeller when pressurized air flows from the impeller, through the shroud port, and into the impeller recirculation flow path during operation of the turbomachine;

wherein the impeller recirculation flow path comprises a radially-elongated diffuser section extending away from the rotational axis of the impeller in a radial direction to reduce the circumferential velocity component of airflow bled from the impeller prior to discharge of the airflow upstream of the impeller;

wherein the radially-elongated diffuser section is located between the shroud port and the trailing end of the impeller, as taken along the rotational axis of the impeller; and wherein the radially-elongated diffuser section comprises an outlet located radially outboard of the impeller.

19. A turbomachine, comprising:

an intake housing assembly containing a main intake plenum and having a sidewall partially bounding the main intake plenum;

an impeller having an inlet in fluid communication with the main intake plenum;

an impeller shroud extending around at least a portion of the impeller and having a shroud port therein; and an impeller recirculation flow path having an inlet fluidly coupled to the shroud port and having an outlet recessed within the sidewall of the intake housing assembly, the impeller recirculation flow path configured to discharge airflow into the main intake plenum at a location radially outboard of the shroud port when pressurized air flows from the impeller, through the shroud port, and into the impeller recirculation flow path during operation of the turbomachine;

wherein the impeller recirculation flow path further comprises a radially-extending diffuser section fluidly coupled between the shroud port and the main intake plenum, the radially-extending diffuser section extending in essentially a radial direction away from a rotational axis of the impeller from a point radially inboard of the impeller to a point radially outboard thereof.

20. The turbomachine of claim 19 wherein the impeller recirculation flow path comprises a diffuser section that is elongated in a radial direction and that is also recessed within the sidewall of the intake housing assembly.

* * * * *